US006511709B1

(12) United States Patent
Barnes et al.

(10) Patent No.: US 6,511,709 B1
(45) Date of Patent: Jan. 28, 2003

(54) METHOD OF DIP COATING FUSER BELT USING ALCOHOL AS A CO-SOLVENT

(75) Inventors: Johnathan Lee Barnes, Richmond, KY (US); Scott Moreland Broce, Broomfield, CO (US); James Craig Minor, Longmont, CO (US); Jennifer Kaye Neely, Erie, CO (US); Dat Quoc Nguyen, Platteville, CO (US); Kasturi Rangan Srinivasan, Longmont, CO (US); Mark Stephen Weisman, Jr., San Diego, CA (US)

(73) Assignee: Lexmark, International, Inc., Lexington, KY (US)

( * ) Notice: Subject to any disclaimer, the term of this patent is extended or adjusted under 35 U.S.C. 154(b) by 0 days.

(21) Appl. No.: 09/930,628

(22) Filed: Aug. 15, 2001

(51) Int. Cl.[7] ..... B05D 1/18; B05D 3/02; B05D 1/36

(52) U.S. Cl. ..... 427/430.1; 427/385.5; 427/407.1; 427/412.1

(58) Field of Search ..... 427/430.1, 385.5, 427/412.1, 407.1

(56) References Cited

U.S. PATENT DOCUMENTS 4,341,455 A 7/1982 Fedder ..... 355/3 TR
4,789,565 A 12/1988 Kon et al. ..... 427/375
5,281,444 A * 1/1994 Hunt ..... 106/14.27
5,309,210 A 5/1994 Yamamoto et al. ..... 355/285
5,397,629 A 3/1995 Jahn ..... 428/265
5,547,759 A 8/1996 Chen et al. ..... 428/421
5,697,037 A * 12/1997 Yano et al. ..... 399/333
5,708,948 A 1/1998 Chen et al. ..... 399/329
5,709,949 A 1/1998 Chen et al. ..... 428/421
5,709,973 A 1/1998 Chen et al. ..... 430/42
5,759,655 A 6/1998 Kitajima et al. ..... 428/36.91
5,765,085 A 6/1998 Law et al. ..... 399/329
5,778,295 A 7/1998 Chen et al. ..... 399/329
5,789,083 A 8/1998 Thomas ..... 428/422
5,824,416 A * 10/1998 Chen et al. ..... 428/421
5,853,892 A 12/1998 Chen et al. ..... 428/421
5,918,099 A 6/1999 Schlueter, Jr. et al. ..... 399/333
5,922,440 A 7/1999 Schlueter, Jr. et al. ..... 428/195
5,945,223 A 8/1999 Kuntz et al. ..... 428/421
5,948,491 A 9/1999 Chen et al. ..... 428/35.7
6,417,284 B1 * 7/2002 Chen et al. ..... 428/351

* cited by examiner

*Primary Examiner*—Michael Barr
(74) *Attorney, Agent, or Firm*—John A. Brady

(57) ABSTRACT

A process for dip coating, particularly vertical dip coating, the topcoat layer onto fuser belts used in electrophotographic processes is disclosed. In this process, a $C_1$–$C_4$ alkanol, such as isopropyl alcohol is added to the solvent system for the fluorocarbon topcoat layer. The use of alcohols in this way provides an efficient and effective method and a topcoat layer which is smooth, uniform and has a good finish.

13 Claims, 1 Drawing Sheet

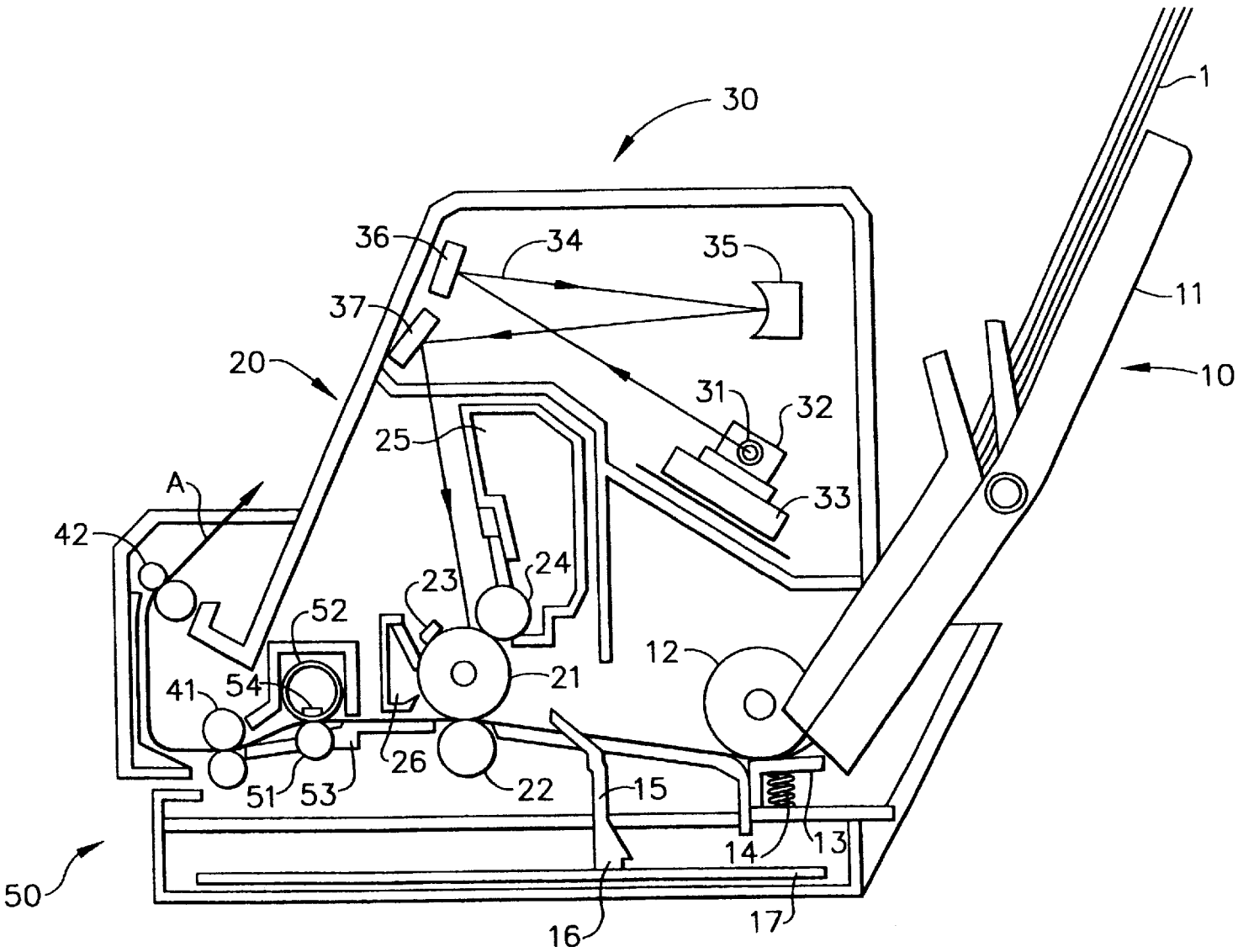
1
11
10
30
35
32
33
31
34
36
37
20
A
42
41
54
52
51
53
26
25
23
24
21
22
12
13
14
15
16
17
50

METHOD OF DIP COATING FUSER BELT USING ALCOHOL AS A CO-SOLVENT

TECHNICAL FIELD

The present invention relates to electrophotographic processes. In particular, it relates to a process for making fuser belts used to fix toner in such processes.

BACKGROUND OF THE INVENTION

In electrophotography, a latent image is created on the surface of an insulating, photoconducting material by selectively exposing an area of the material's surface to light. A difference in electrostatic density is created between the areas on the surface exposed and those unexposed to the light. The latent electrostatic image is developed into a visible image by electrostatic toners which contain pigment components and thermoplastic components. The toners, which may be liquids or powders, are selectively attracted to the surface of the photoconductor, either exposed or unexposed to light, depending upon the relative electrostatic charges on the photoconductor surface, the development electrode and the toner. The photoconductor may be either positively or negatively charged, and the toner system similarly may contain negatively or positively charged particles.

A sheet of paper or intermediate transfer medium is given an electrostatic charge opposite that of the toner and then passed close to the photoconductor surface, pulling the toner from that surface onto the paper or intermediate medium still in the pattern of the image developed from the photoconductor surface. A set of fuser rolls or belts, under heat, melts and fixes the toner in the paper subsequent to transfer, producing the printed image.

The electrostatic printing process, therefore, comprises an intricate and on-going series of steps in which the surface of the photoconductor is charged and discharged as the printing takes place. In addition, during the process, various charges are formed on the photoconductor surface, the toner and the paper surface to enable the printing process to take place. Having the appropriate charges in the appropriate places at the appropriate times is critical to making the process work.

After the image is transferred to the paper or other recording medium, it goes to the fuser where the paper is moved through a nip where it is heated and pressed. This melts the thermoplastic portion of the toner, causing it to bond with the fibers of the paper, thereby fixing the image onto the paper or recording medium. In the past, the majority of fuser assemblies used a fuser roll. These fuser rolls are typically aluminum cylinders with a heating lamp inside and a release coating on the outside. In this system, paper or transparency film with a toner image on it is passed through the fusing nip formed between the fuser roll and a backing roll. As the toner image passes through the fuser nip, the heat and pressure fuse the toner image to the paper or transparency film. This system has been used for many years because of its simplicity and functionality in high speed systems. The problem with this system, however, is that it requires the fuser roll to preheat before it may operate. This is true even with the machine in standby mode between printing or copying jobs. The need for preheating is the result of the large heat capacity of fuser roll. This preheating means a delay for the user before each printing or copying job can be started.

In recent years, a new on-demand fusing system has been developed and is being used in the industry to minimize this delay problem. This system is mainly composed of a ceramic heater and a thin film belt through which the heat is transferred to the toner-laden image. The ceramic heater is thin and has a small heat capacity compared to the fuser roll. The fuser belt is designed to conduct the heat from the heater to the toner image with minimal resistance. The contact of the belt with the paper going through the fuser nip is the driving force for the belt to turn around the ceramic heater. The nip for the fuser belt system is formed by the fuser belt and a backing roll. The net result is a system which essentially eliminates any significant time delay caused by initial heating of the fuser system.

The fuser belt described above is typically composed of three layers. The first layer is a polymer film. This polymer film is the main substrate which gives the fuser belt structural integrity. The film must have specific properties regarding flexibility, as well as physical tolerances to high temperatures and repeated heating and cooling cycles. The polymer film must also be a good conductor of heat. The polymer chosen for this film is typically a polyimide with a material, such as boron nitride, dispersed within it for improved heat conduction. The current industry standard for producing this polymer film is a vertical dip coating technique carried out on a specially coated metal mandrel. After the polymer has been cured, it is slipped off the coating mandrel and is coated with one, two or more layers to form the finished belt.

The second layer of the fuser belt typically is a conductive primer coating. This layer provides a path within the finished belt for static charge dissipation. At one end of the fuser belt, there is a strip of exposed conductive primer, providing a place to ground the belt and to remove the static charge generated during belt operation. This is important because there can exist an electrostatic offset phenomenon whereby the toner is electrostatically transferred from the paper or transparency film to the fuser belt. This is undesirable since, when it happens, the toner transferred previously as a result of the offset is then fused to the print copy. This phenomenon produces a ghost-like image that deteriorates the overall image quality. The grounding clip, which is in contact with the strip of the exposed conductive primer coating, provides a path for charge dissipation and thus reduces the electrostatic offset phenomenon.

The third layer of the fixing belt is composed of a release coating. A primary purpose of this coating is to provide a surface to which the toner will not adhere during fusing. A second purpose of this coating layer is to provide a strong wear layer for the belt. As stated above, the preferred method for manufacturing fuser belts utilizes a vertical dip coating method. A number of problems result when attempts are made to apply a typical topcoat material, such as a fluoropolymer, to the fuser belt using this vertical dip coating technique. First, the coating solution does not wet the polymer tube in a uniform sheet. Instead, the coating runs and drips off the belt during coating. This results in a topcoat which is not uniform or smooth. Second, the topcoat tends to crack when it is exposed to high temperatures (for example, greater than 350° C.), such as during the sintering operation which is necessary for drying and curing the polymer and other coatings. Finally, the topcoat coating solution is frequently not stable for long enough to remain uniform throughout the coating process. When the solution sits for a few minutes, it frequently tends to separate into a non-homogenous solution. It therefore would be useful to develop a process which allows topcoat materials, such as fluoropolymers, to be applied to fuser belts, using the vertical dip coat technique in an efficient and effective manner. The present invention addresses that objective.

U.S. Pat. No. 5,853,892, Chen, et al., issued Dec. 29, 1998, describes the use of an amorphous fluoropolymer in the outer layer of a belt used for fusing a thermoplastic resin toner image to a substrate. The fuser belt coatings are said to require a lower sintering temperature than the conventional semi-crystalline fluoropolymers.

U.S. Pat. No. 5,778,295, Chen, et al., issued Jul. 7, 1998, describes the preparation and use of a fuser belt comprising a seamless polyimide substrate belt, a cross-linked silicone resin intermediate layer and a surface layer containing a silsesquioxane polymer.

U.S. Pat. No. 5,709,973, Chen, et al., issued Jan. 20, 1998, discloses a metal fuser belt comprising an unmatted powder-coated polytetrafluoroethylene-co-perfluoropropyl vinyl ether copolymer (PFA), an unmatted powder-coated tetrafluoroethylene-hexafluoropropylene co-polymer and an aqueous spray-coated blend of polytetrafluoroethylene and PTFE-perfluorinated vinyl ether.

U.S. Pat. No. 5,708,948, Chen, et al., issued Jan. 13, 1998, describes the preparation of a fuser belt by curing a composition comprising siloxanes whose average molecular weight ranges from 5,000 to 50,000 g/mole, the ratio of di-functional to tri-functional units varies from 1:1 to 1:2.7, and the ratio of alkyl to aryl groups varies from 1:0.1 to 1:1.2.

U.S. Pat. No. 5,547,759, Chen, et al., issued Aug. 20, 1996, discloses a fuser member comprising a metal element, a fluoroelastomer layer, a primer layer and a fluoropolymer resin layer. The fluoroelastomer layer contains a vinylidene fluoride-hexafluoropropylene co-polymer or a vinylidene fluoride-hexafluoropropylene-tetrafluoropropylene terpolymer. The primer layer contains a fluoropolymer resin and a polyamide-imide. The fluoropolymer resin layer contains a polytetrafluoroethylene-polyperfluoroalkoxy-tetrafluoroethylene and/or a polyfluoronated ethylene-propylene.

U.S. Pat. No. 5,697,037, Yano, et al., issued Dec. 9, 1997, describes a fixing member comprising a heat resistant film (preferably a polyimide film) coated with a conductive primer layer and a surface layer comprising a fluorine-containing resin and an ion-conductive material, whose melting point is greater than the maximum temperature achieved by the fixing device. The surface layer of the heat-resistant film is a polyimide, polyamide or polyphenyleneoxide. The fluorine-containing resin includes polytetrafluoroethylene, tetrafluoroethylene-perfluoroalkylvinyl ether copolymer and tetrafluoroethylene-hexafluoropropylene copolymer.

U.S. Pat. No. 5,759,655, Kitajima, et al., issued Jun. 2, 1998, discloses the preparation of a fuser belt, by coating a conducting primer layer onto a seamless layer that contains polyimide. A baked fluororesin containing carbon black is coated over the conductive primer layer. The conductive primer layer contains at least one resin selected from polyphenylene sulfide, polyethersulfone, polysulfone, polyamide, polyimide, and their derivatives. The fluororesin is selected from polytetrafluoroethylene (PTFE) polyfluoroethylene-perfluoroalkylvinyl ether copolymer (PFA), and tetrafluoroethylene-hexafluoropropylene copolymer (FEP).

U.S. Pat. No. 4,341,455, Fedder, issued Jul. 27, 1982, describes a dielectric transfer belt (not a fuser belt) which is used to transfer toner to paper in an electrostatic printing process.

U.S. Pat. No. 4,789,565, Kon et al., issued Dec. 6, 1988, teaches a method for coating a roller with a PTFE dispersion using a horizontal dip process. The procedure described does not suggest the use of isopropyl alcohol in the topcoat solution.

U.S. Pat. No. 5,309,210, Yamamoto et al., issued May 3, 1994, describes a belt fuser apparatus for use in electrophotographic processes. The belt includes a fluororesin in the belt structure. The patent contains no details of the release layer or how the release layer is put onto the fuser belt.

U.S. Pat. No. 5,397,629, Jahn, issued Mar. 14, 1995, describes a method for applying fluoropolymers onto textiles using isocyanate adhesion promoters. The patent teaches the use of thickeners, such as pectin and polyvinyl alcohol, in the fluororesin formulations. This disclosure does not deal with the manufacture of electrophotographic fuser rolls and the application of fluoropolymers to a textile surface is based on a completely different dynamic than is the dip coating of a polyimide fuser belt.

U.S. Pat. No. 5,709,949, Chen, et al., issued Jan. 20, 1998, describes spraying and dip processes for coating fluoropolymer release layers onto electrophotographic fuser members. There is no suggestion in this patent of the use of isopropyl alcohol solvent in those processes.

U.S. Pat. No. 5,765,085, Law et al., issued Jun. 9, 1998, describes an electrophotographic fixing belt which may incorporate fluorocarbons into its outer release layer. The patent includes a general disclosure of solvents which can be used in this coating process; isopropyl alcohol is not included in that list.

U.S. Pat. No. 5,789,083, Thomas, issued Aug. 4, 1998, describes a fluorocarbon primer that can be used on smooth (metal) substrates. The described process utilizes an acrylate copolymer (Primal RM-5) as a thickener. The described process does not deal with the coating of electrophotographic fixing belts or the use of acrylate homopolymers in the disclosed process.

U.S. Pat. No. 5,918,099, Schlueter, Jr., et al., issued Jun. 29, 1999, describes an electrophotographic fuser belt which incorporates a polyphenylene sulfide layer and a fluororesin release layer. There is no discussion of solvents used to facilitate the fluororesin coating process.

U.S. Pat. No. 5,922,440, Schlueter, Jr., et al., issued Jul. 13, 1999, describes electrophotographic fuser belts and includes a general disclosure on coating techniques used in the preparation of such belts.

U.S. Pat. No. 5,945,223, Kuntz et al., issued Aug. 31, 1999 describes a flow coating method for forming fixing rollers used in electrophotographic processes. In this procedure, a fluororesin is applied from a solution (not an aqueous dispersion). Numerous solvents are disclosed for use with the fluororesin; isopropyl alcohol is not among them.

U.S. Pat. No. 5,948,491, Chen, et al., issued Sep. 7, 1999, includes a general discussion of Teflon release layers which can be included in toner fuser members used in electrophotographic processes.

SUMMARY OF THE INVENTION

The present invention relates to an improvement in a method for coating a polyimide film, such as a fuser belt, with a fluorocarbon material which comprises dipping the polyimide film into an aqueous-based solution which comprises from about 30% to about 50% of said fluorocarbon and from about 5% to about 15% (preferably from about 5% to about 10%) by weight of a $C_1$–$C_4$ alkanol, preferably isopropyl alcohol, and drying said fluorocarbon layer.

BRIEF DESCRIPTION OF THE DRAWING

The FIGURE is a schematic view of a laser printer representing a typical electrophotographic apparatus, particularly one used in a desktop printer or copier.

DETAILED DESCRIPTION OF THE INVENTION

The present invention relates to an efficient and effective method for coating a polyimide fuser belt with a fluorocarbon release material. The method is particularly useful in conjunction with a vertical dip coating process. In this procedure, the aqueous solution which includes the fluorocarbon also includes from about 5% to about 10% by weight of isopropyl alcohol. This coating technique can improve the wetting of belt by the fluorocarbon solution, providing a uniform and smooth topcoat surface on the belt.

A standard design for a laser printer, a representative electrophotographic device, is shown the FIGURE. It includes a paper feed section (10), an image-forming device (20), a laser scanning section (30), and a fixing device (50). The paper feed section (10), sequentially transports sheets of recording paper (or other printing media) (1) to the image-forming device (20) provided in the printer. The image-forming device (20) transfers a toner image to the transported sheet of recording paper (1). The fixing device (50) fixes that toner image to the sheet of recording paper (1) sent from the image-forming device (20). Thereafter, the sheet of recording paper (1) is ejected out of the printer by the paper transport rollers (41,42). In short, the sheet of recording paper (1) moves along the path denoted by arrow A in the FIGURE. It is to be understood that, as used herein, the terms "recording paper" or "paper" are intended to include any and all recording printing media which may be fed through an electrostatic printer (e.g., paper, transparencies, labels, envelopes, note paper).

The paper feed section (10) includes a paper feed tray (11), a paper feed roller (12), a paper separating friction plate (13), a pressure spring (14), a paper detection actuator (15), a paper detection sensor (16), and a control circuit (17).

Upon receiving a print instruction, the sheets of recording paper (or other printing media) (1) placed in the paper feed tray (11) are fed one-by-one into the printer by operation of the printer feed roller (12), the paper separating friction plate (13) and the pressure spring (14). As the fed sheet of recording paper (1) pushes down the paper detection actuator (15), the paper detection sensor (16) outputs an electrical signal instructing commencement of printing of the image. The control circuit (17), started by operation of the paper detection actuator (15), transmits an image signal to a laser diode light-emitting unit (31) of the laser scanning section (30) so as to control on/off of the light-emitting diode.

The laser scanning section (30) includes the laser diode light-emitting unit (31), a scanning mirror (32), a scanning mirror motor (33), and reflecting mirrors (35, 36 and 37).

The scanning mirror (32) is rotated at a constant high speed by the scanning mirror motor (33). As a result, laser light (34) scans in a vertical direction to the paper surface of the FIGURE. The laser light (34) radiated by the laser diode light-emitting unit (31) is reflected by the reflecting mirrors (35, 36 and 37) so as to be applied to the photosensitive body (21). As the printer operates, the photosensitive body (21) is selectively exposed to the laser light (34) in accordance with on/off information from the control circuit (17).

The image-forming device (20) includes the photosensitive body (21), a transfer roller (22), a charging member (23), a developing roller (24), a developing unit (25), and a cleaning unit (26). The surface charge of the photosensitive body (21), charged in advance by the charging member (23), is selectively discharged by the laser light (34). An electrostatic latent image is thus formed on the surface of the photosensitive body (21). This electrostatic latent image is visualized by the developing roller (24), and the developing unit (25). Specifically, the toner supplied from the developing unit (25) is adhered to the electrostatic latent image on the photosensitive body (21) by the developing roller (24) so as to form the toner image.

The toner used for development is stored in the development unit (25). The toner contains coloring components (such as carbon black for black toner) and thermoplastic components. The toner, charged by being appropriately stirred in the developing unit (25), adheres to the above-mentioned electrostatic latent image by an interaction of the developing biased voltage applied to the developing roller (24) and an electric field generated by the surface potential of the photosensitive body (21), and thus conforms to the latent image, forming a visual image on the photosensitive body (21). The toner typically has a negative charge when it is applied to the latent image, forming the visual image.

The sheet of recording paper (1) is then transported from the paper feed section (10) downstream while being pinched by the photosensitive body (21) and the transfer roller (22). The paper (1) arrives at the transfer nip in timed coordination with the toner image on the photosensitive body (21). As the sheet of recording paper (1) is transported downstream, the toner image formed on the photosensitive body (21) is electrically attracted and transferred to the sheet of recording paper (1) by an interaction with the electrostatic field generated by the transfer voltage applied to the transfer roller (22). Any toner that still remains on the photosensitive body (21), not having been transferred to the sheet of recording paper (1), is collected by the cleaning unit (26). Thereafter, the sheet of recording paper (1) is transported to the fixing device (50). In the fixing device (50), an appropriate temperature and pressure are applied while the sheet of recording paper (1) is being pinched by moving through the nip formed by the pressure roller (51) and the fixing belt (52) that is maintained at an elevated temperature. The thermoplastic components of the toner are melted by the fuser belt (52) and fixed to the sheet of recording paper (1) to form a stable image. The sheet of recording paper (1) is then transported and ejected out of the printer by the printer transport rollers (41, 42).

Next, the operation of the fixing device (50) will be described in detail. The fixing device (50) includes the backup (or pressure) roller (51) and the fixing belt (52). The fixing belt is generally an endless belt or tube formed from a highly heat resistant and durable material having good parting properties and a thickness of not more than about 100 $\mu$m, preferably not more than about 70 $\mu$m. Preferred belts are made from a polyimide film. The belt also includes an outer coating of, for example, a fluororesin or Teflon material to optimize release properties of the fixed toner from the belt, and may also optionally include a primer layer. Such fuser belts are well known in the art. A heater (54), generally a ceramic heater, is placed on the inside surface of the belt and the outside surface of the belt forms a fusing nip with the backup roller (51) at the location of the heater. Put another way, the heater (54) and the backup roller (51) form the nip, with the fuser belt (52) interposed between them. Each page carrying the toner travels through this nip (i.e., between the fuser belt (52) and the backup roller (51)) and the toner is fixed to the page through the combination of applied heat, the time the page is in the fuser nip, and pressure. Typically, the pressure between the fuser belt (52) and the backup roller (51) at the fuser nip is from about 5 to about 30 psi. While the fuser belt (52) may be driven itself, often this is not the case. Frequently, the backup roller (51) is rotated and it is the friction between the surface of the backup roller (51) and the printed page and ultimately the surface of the user belt (52), which causes the fuser belt (52) to rotate.

The backup or pressure roller (51) is cylindrical in shape. It is made from or is coated with a material that has good release and transport properties for the recording paper (1). Backup roller (51) is sufficiently soft so as to allow it to be rotated against the fuser belt (52) to form a nip through which the printed pages travel. By going through this nip, printed pages are placed under pressure and the combined effects of this pressure, the time the page is in the nip, and the heat from the fuser belt (52) act to fix the toner onto the paper. A preferred material for use in forming the backup roller (51) is silicone rubber. The roller typically has an aluminum core with a silicone rubber layer molded or adhesively bonded onto its surface. The roller may also have a fluoropolymer (e.g., Teflon) sleeve or coating on it to enhance its release properties.

The fuser belt utilized in the present invention is typically composed of three layers. These layers include the belt or substrate itself, an optional primer layer, and the release coating (topcoat). The belt itself is generally made from a polymer film. This polymer film is the main substrate which gives the belt structural integrity. It must have specific properties regarding flexibility, as well as physical tolerances to high temperatures and repeated heating and cooling cycles. This polymer film must also be a good conductor of heat. The preferred material for use in forming the substrate is a polyimide material since these materials tend to have the required chemical stability, thermal stability, solvent resistance, and cost properties.

Suitable polyimides include those formed from various diamines and dianhydrides, such as polyamide-imide), polyetherimide, siloxane polyetherimide block copolymer such as, for example, SILTEM STM-1300 available from General Electric, Pittsfield, Mass., and the like. Preferred polyimides include aromatic polyimides such as those formed by reacting pyromellitic acid and diaminodiphenylether (sold under the tradename KAPTON®Type-HN, available from DuPont). Another suitable polyimide available from DuPont and sold as KAPTON®Type-FPC-E, is produced by imidization of copolymeric acids such as biphenyltetracarboxylic acid and pyromellitic acid with two aromatic diamines such as p-phenylenediamine and diaminodiphenylether. Another suitable polyimide includes pyromellitic dianhydride and benzophenone tetracarboxylic dianhydride copolymeric acids reacted with 2,2-bis[4-(4-aminophenoxy) phenoxy]-hexafluoropropane, available as EYMYD®, Type L-20N, from Ethyl Corporation, Baton Rouge, La. Other suitable aromatic polyimides include those containing 1,1', 2,2'-biphenyltetracarboximide and paraphenylene groups such as UPILEX®-S, available from Uniglobe Kisco, Inc., White Plains, N.Y., and those having biphenyltetracarboximide functionality with diphenylether end spacer characterizations, such as UPILEX®-R, also available from Uniglobe Kisco, Inc. Mixtures of polyimides can also be used.

The polyimide is present in the film in an amount of from about 60 to about 99.9 percent by weight of total solids, preferably from about 80 to about 90 percent by weight of total solids. Total solids, as used herein, includes the total percentage by weight of polymer, conductive fillers and any additives in the layer.

The material used for forming the substrate frequently has dispersed within it a material, such as boron nitride, in order to enhance the heat conduction of the substrate. The heat-conductive material generally comprises from about 0.1% to about 40%, preferably from about 10% to about 20%, by weight of the substrate. The preferred belt for use in the present invention is a polyimide film having boron nitride dispersed within it. Examples of other preferred conductive filler materials include fluorinated graphite and conductive carbon black. A particularly preferred material is boron nitride.

The current industry standard for producing belts made from a polyimide film utilizes a vertical dip coating process on a specially coated metal mandrel. After the polymer has been cured, it is slipped off of the mandrel and is coated with the remaining layers (for example, by vertical dip coating) to form the finished belt.

The second layer which is placed on the polyimide film is optional, but preferred, and comprises a conductive primer coating. This layer provides a path within the finished belt for static charge dissipation. This is important since the nature of the fusing process centers around surfaces rubbing against each other, and that encourages the formation of static charge. At one end of the fuser belt, there is a strip of exposed conductor primer, providing a place to ground the belt and to remove the static charge generated during the belt operation. This is important because the build-up of static charge can result in offset phenomenon whereby the toner is electrostatically transferred from the paper or transparency film to the fuser belt. This is undesirable since, once the fuser belt has revolved around the ceramic heater, the offset toner transferred previously to the fuser belt is then fused onto the transfer material. This phenomenon produces a ghost-like image that deteriorates the overall quality of the image. The grounding clip that is in contact with the strip of exposed conductive primer coating on the fuser belt provides a path for charge dissipation and thus reduces the electrostatic offset phenomenon. The primer layer must be conductive. The desired resistivity of this layer is between about 1E3 and about 1E6 ohms/cm$^2$. The thickness required to achieve this is from about 1 to about 5 microns, preferably about 3 microns. The exposed primer grounding strip is generally from about 3.5 to about 6.5 microns thick, preferably about 5 microns thick. Examples of materials which can be used as the conductive primer layer include polytetrafluoroethylene (PTFE) tetrafluoroethylene-perfluoroalklyvinylether copolymers (PFA), tetrafluoroethylene hexafluoropropylene copolymers (FEP), and polyamide-imide polymers, together with a conductive additive such as conductive carbon black. Examples of preferred primer materials include the water-based primer dispersions commercially available from DuPont, product codes 857-101, 855-321, 855-021, 855-023, and 855-029. An example of a particularly preferred material is water-based Teflon Mica-Free Primer Black, DuPont product code 855-029.

The third (topcoat) layer of the fixing film is composed of a release coating. The primary purpose of this coating is to provide a surface to which the toner will not adhere during fusing. A second purpose of this coating layer is to provide a strong wear-resistant layer for the belt. The outer parting layer is typically comprised of a fluorocarbon material, such as polytetrafluorethylene (PTFE), tetrafluoroethylene-perfluoroalklyvinylether copolymers (PFA), and tetrafluoroethylene hexafluoropropylene copolymers (FEP). Examples of preferred topcoat materials include the water-based topcoat dispersions commercially available from DuPont, product codes 855-103, 857-301, 855p25110, 855p25113, 857-222, 855-104, 855-500, 855-411, 855p25119, and 857-210. Examples of particularly preferred materials are water-based Teflon Topcoat Clear, DuPont product code 857-210 and water-based Conductive Topcoat Black, DuPont product code 855-411.

The present invention is actually a process for applying the topcoat layer onto the fuser belt substrate. This can be accomplished using any coating process known in the art, although it is particularly adapted for use with a vertical dip coating process. In this process, an aqueous-based solution containing from about 30% to about 50% of the fluorocarbon material is formulated using standard techniques.

In the present invention, a lower ($C_1$–$C_4$) alkanol, such as propanol, methanol, ethanol or butanol, preferably isopropyl alcohol is included in the solvent system of the fluorocarbon topcoat material. The alkanol comprises from about 5% to about 15% of the dispersion, preferably from about 5% to about 10%, most preferably about 7%. Preferred fluorocarbon dispersions contain from about 30% to about 34% of total solids, when the alkanol is used in the solvent system. In general, the inclusion of alkanol improves the coating quality and the surface finish of the topcoat.

The process for vertical dip coating fuser belts, as described in the present application, is demonstrated in the following examples.

EXAMPLES

Polyamide Tube

A conductive substrate, specifically a boron nitride-containing polyamide tube was used for all examples given herein.

Conductive Primer Layer

The conductive primer layer in the example is dip coated on the substrate using a DuPont water-based dispersion called Teflon Mica-Free Primer Black, product code 855-029. This product contains polytetrafluoroethylene (PTFE), a polyamide-imide polymer, and a conductive carbon black.

The 855-029 dispersion is premixed by gently rolling the dispersion for at least five hours and then an aliquot is let down with deionized water to 17% solids. A small amount of surfactant can be added to improve coating quality. Typically, Triton-X-100, commercially available from Rohm and Haas, is used at 0.1% by weight of the let-down. The resulting formulation is then mixed gently by stirring for enough time to allow the solution to become homogeneous and to degas. Just prior to coating, the formulation is filtered to remove large agglomerates. Once coated, the belt is dried at 150° C. for at least 15 minutes.

The primer layer, for reasons discussed above, must be conductive. The desired resistivity is between about 1E3 and 1E6 ohms/cm$^2$. The thickness required to achieve this is approximately 1 to 5 microns, preferably about 3 microns. The exposed primer grounding strip must be about 3.5 to about 6.5 microns thick, preferably about 5 microns thick.

Fluorocarbon Topcoat

The base for the topcoat formulation is a mixture of two DuPont products, one called Teflon Topcoat-Clear, product code 857-210, the other Teflon Topcoat-Black, Product Code 855-411. The 857-210 dispersion is approximately 45% solids and is water-based. It contains small amounts of diethylene glycol monobutyl ether, oleic acid, triethanolamine, 1,2,4-trimethyl benzene, and an aromatic hydrocarbon. The solids consist primarily of perfluoroalkoxy resin such as polytetrafluoroethylene (PTFE), tetrafluoroethylene-perfluoroalkylvinylether copolymer (PFA), or tetrafluoroethylene hexafluoropropylene copolymer (FEP) and small amounts of octylphenoxypolyethoxyethanol surfactant. The 855-411 dispersion contains the same materials as does the 857-210 dispersion with the addition of carbon black for electrical conductivity.

The DuPont dispersions are gently rolled for a period of time to resuspend the solids. The two topcoat dispersions are combined in a weight ratio of 60:40 parts, 857-210 to 855-411, respectively. The desired amount of isopropyl alcohol (from about 5% to about 15%, preferably from about 5% to about 10%, most preferably about 7%, by weight of the combined total of topcoat dispersion), is combined with the amount deionized water necessary to reduce the total solids to from about 30% to about 34%, preferably from about 32% to about 33%). The topcoat dispersions are gently agitated with stirring while the water/isopropyl alcohol mixture is slowly added. Once the water/isopropyl alcohol mixture has been added, the mixture is gently stirred for a period of 24 hours to allow it to become homogeneous and to de-gas. Prior to coating, the mixture is filtered to remove any agglomerates. (Total solids are defined as the percentage of residual materials left after drying for 16 hours at 200° C.)

The belts are coated using a vertical dipping process with the topcoat mixture, over the previously coated and dried primer, leaving a grounding stripe of approximately 5 cm in width. Once coated, the belt is dried at 150° C. for 15 minutes, followed by sintering at 385° C. for two hours.

The topcoat layer must be from about 9 to about 15 microns thick, preferably about 12 microns. The roughness ($R_Z$) of the layer must be no greater than about 11 microns, preferably no greater than about 6 microns.

Results

In the absence of alcohol, the topcoat dispersions were unstable and coated poorly on the primed substrate. The poor coating uniformity of the topcoat resulted in a belt with unacceptable surface finish. In order to improve the coating uniformity, surface finish, and dispersion stability of the topcoat, isopropyl alcohol was added at various concentrations to the topcoat mixture. Surface finish, dispersion stability, and coating uniformity were evaluated. (Table 1.)

TABLE 1

IPA Concentration Study.

| IPA Concentration (%) | Topcoat Thickness (microns) | Roughness, Rz (microns) | Coating Quality |
|---|---|---|---|
| 0 | 6 | 10.52 | Poor |
| 0.1 | 8.3 | 11.02 | Poor |
| 0.2 | 8.1 | 10.72 | Poor |
| 0.35 | 9.5 | 11.18 | Poor |
| 1 | 9.3 | 10.71 | Poor |
| 2 | 7.8 | 6.75 | Fair |
| 5 | 8.7 | 5.45 | Good |
| 7 | 13.6 | 5.42 | Good |
| 10 | 13.3 | 7.11 | Good |
| 15 | 7.2 | 4.43 | Good |

The results in Table 1 indicate that anywhere from about 5% to about 15% IPA added to the topcoat mixture improved the surface finish and coating uniformity of the belts. In a separate study the topcoat dispersion stability was found to be best at IPA concentrations from 5% to 10%, preferably 7%.

Other alcohols, such as butanol, methanol, or ethanol, exhibited the same effects on topcoat stability and coating uniformity. Belts coated with topcoats containing other alcohols had acceptable surface finish, but the surface finish was found to be best with isopropyl alcohol.

Evaluation of belts coated with the modified formulation showed the roughness, thermal conductivity, primer resistivity, and thickness to be acceptable. Further print test evaluation was done on a Lexmark Optra S 3450 printer. The results showed similar fuse grade and print quality compared to a control belt that had been coated with an unmodified topcoat containing no isopropyl alcohol, indicating that co-solvent had no adverse effect on belt function.

These examples indicate that a vertical dip process for coating of fuser belts with a Teflon release layer was successfully defined. As received, the water-reduceable coating formulations are not suitable for a vertical dipping process. The addition of an alcohol, preferably isopropyl alcohol, in the range are from about 5% to about 15%, preferably about 7%, by weight produces a stable dispersion and a high quality coating with an excellent surface finish.

What is claimed is:

1. In a method for coating a polyimide film with a fluorocarbon, said film being a continuous belt for a belt fuser, the improvement which comprises dipping said film into an aqueous-based solution which comprises from about 30% to about 50% by weight of said fluorocarbon, and about 7% by weight of a $C_1$–$C_4$ alkanol, and drying said fluorocarbon layer.

2. The coating method according to claim 1 wherein the alkanol is selected from methanol, ethanol, butanol, propanol, and mixtures thereof.

3. The coating method according to claim 2 wherein the alkanol is isopropyl alcohol.

4. The coating method according to claim 3 wherein the polyimide film has coated on its outer surface a conductive primer layer.

5. The coating method according to claim 4 wherein the fluorocarbon is a perfluoroalkoxy resin.

6. The coating method according to claim 5 wherein the coating takes place by a vertical dip coating technique.

7. The coating method according to claim 6 wherein the coating solution contains from about 30 to about 34% by weight total solids.

8. The coating method according to claim 6 wherein the fluorocarbon is selected from the group consisting of polytetrafluoroethylene, tetrafluoroethylene-perfluoroalkylvinylether copolymers, and tetrafluoroethylene hexafluoropropylene copolymers.

9. The coating method according to claim 6 wherein the fluorocarbon layer has a thickness of from about 9 to about 15 $\mu$m.

10. The coating method according to claim 6 wherein the fluorocarbon layer has a roughness ($R_Z$) of no greater than about 6 $\mu$m.

11. The coating method according to claim 6 wherein the fluorocarbon material is selected from the group consisting of polytetrafluoroethylene, tetrafluoroethylene-perfluoroalkylvinylether copolymers, and tetrafluoroethylene hexafluoropropylene copolymers and the coating solution contains from about 30% to about 34% by weight total solids.

12. The coating method according to claim 11 wherein the fluorocarbon layer has a thickness of from about 9 to about 15 $\mu$m and a roughness ($R_Z$) of no greater than about 6 $\mu$m.

13. The coating method according to claim 6 wherein the fluorocarbon layer is dried by heating.

* * * * *